US006910408B2

(12) United States Patent
Weberruss et al.

(10) Patent No.: US 6,910,408 B2
(45) Date of Patent: Jun. 28, 2005

(54) LINEAR DRIVE WITH NO CONNECTING ROD

(75) Inventors: Rolf Weberruss, Kernen (DE); Gerhard Krafft, Ostfildern (DE); Thomas Wagner, Remseck (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 10/467,029

(22) PCT Filed: Jan. 25, 2002

(86) PCT No.: PCT/EP02/00740

§ 371 (c)(1),
(2), (4) Date: Aug. 1, 2003

(87) PCT Pub. No.: WO02/075163

PCT Pub. Date: Sep. 26, 2002

(65) Prior Publication Data

US 2004/0060434 A1 Apr. 1, 2004

(30) Foreign Application Priority Data

Feb. 28, 2001 (DE) ..... 101 09 482

(51) Int. Cl.[7] ..... F01B 29/00
(52) U.S. Cl. ..... 92/88
(58) Field of Search ..... 92/88; 244/63

(56) References Cited

U.S. PATENT DOCUMENTS

| | | | | |
|---|---|---|---|---|
| 4,555,980 A | * | 12/1985 | Hoglund | 92/88 |
| 4,852,465 A | | 8/1989 | Rosengren | 92/88 |
| RE34,049 E | * | 9/1992 | Taki et al. | 92/88 |
| 5,778,758 A | * | 7/1998 | Barth et al. | 92/88 |

FOREIGN PATENT DOCUMENTS

| | | |
|---|---|---|
| DE | 35 09 891 A1 | 9/1986 |
| DE | 94 10 393 U1 | 9/1994 |
| EP | 0 690 237 B1 | 6/1999 |
| EP | 0 969 213 A2 | 1/2000 |

* cited by examiner

*Primary Examiner*—Edward K. Look
*Assistant Examiner*—Devin Hanan
(74) *Attorney, Agent, or Firm*—Hoffmann & Baron, LLP

(57) ABSTRACT

A piston rod-less linear drive (1) has a housing (2) with a longitudinal slot (5) having a moving force coupling member extending through it. The outer slot opening (7) is provided with at least one covering band (33), which is fixed at an attachment section (34) on a longitudinal side (37) of the outer slot opening (7). The covering band ( )33) furthermore has a pivoting covering section (35), which is provided with detent means (46), which render possible a releasable detent function in a covering position covering the outer slot opening. Actuating means kinematically coupled with the force coupling member may act on the covering band in order to cause the detent locking action.

20 Claims, 6 Drawing Sheets

LINEAR DRIVE WITH NO CONNECTING ROD

This application claims priority based on an International Application filed under the Patent Cooperation Treaty, PCT/EP02/00740, filed on Jan. 25,2002, and German Patent Application No. DE 101 09 482.5, filed on Feb. 28, 2001.

FIELD OF THE INVENTION

The invention relates to a piston rod-less linear drive comprising a housing, which has a slot aligned longitudinally and having a movable force coupling member extending through it, the outer opening of the slot being provided with a covering means having at least one covering band, the covering band having an attachment section fixed to the housing on a first longitudinal side of the outer slot opening and a pivotal covering section able to be pivoted between a covering position covering the outer slot opening and a free position permitting the extension of the force coupling member through the slot.

BACKGROUND OF THE INVENTION

A piston rod-less drive of this type is disclosed in the German patent publication 3,509,891 A1. It possesses a housing in which a piston is arranged able to be slid by fluid power and is drivingly coupled with a power transmitting member extending through a longitudinal slot in the housing. In order to prevent escape of fluid the inner slot opening facing the piston receiving space of the longitudinal slot is provided with a sealing band. At the outer slot opening located at the outer face of the housing a covering band is provided, which extends along the length of the slot and is secured to the housing at an attachment section on the long side to a first longitudinal side of the outer slot opening. A covering section, pivotally connected with this attachment section, of the covering band covers the outer slot opening axially on either side of the power transmitting member in order to prevent the ingress of dirt into the longitudinal slot. At the power transmitting member the covering section is pivoted outward into a hatch-open position in order to permit the extension of the force coupling member through an opening with the function of a hatch. This hatch zone is displaced along the longitudinal slot in accordance with the movement and instantaneous position of the piston and of the force coupling member connected with it.

The assumption of the covering position of the covering section is in the case of the known linear drive to be ensured by a sufficient biasing effect, which automatically returns the covering section and also the correspondingly fashioned sealing band, after pivoting into the release position automatically. The biasing effect is produced by a connecting rib integrally made with the covering band and the sealing band, such rib extending through the longitudinal slot. In this case there is however the disadvantage that in the course of time material fatigue will impair reliable assumption of the covering position.

Similar problems occur with the covering band based on the same principles in accordance with the U.S. Pat. No. 4,555,980. Departing from the design in accordance with the German patent publication 3,509,891 A1 the covering means in this case however has two covering bands which jointly cover the longitudinal slot.

Admittedly there has in the said U.S. Pat. No. 4,555,980 also been a suggestion to secure the covering band by means of a releasable detent connection with the sealing band in the covering position.

However in this case a different type of covering band is provided, in the case of which the covering band has its full width moved clear of the longitudinal slot at the force coupling member, something which as regards the force coupling member demands a complicated structure, because it must be provided with a passage for the covering band to run through.

SUMMARY OF THE INVENTION

Accordingly one object of the present invention is to provide a linear drive of the type initially mentioned, which while having a simple structure ensures reliable covering of the longitudinal slot even after a long period of use.

In order to fulfill this aim detent means are provided on the pivotally moving covering section for releasable detent-wise locking in the covering position and actuating means are provided kinematically coupled with the force coupling member, such actuating means acting on the associated covering band in order to bring about a detent locking effect.

The covering means is accordingly designed with at least one covering band, which at the instantaneous position of the force coupling member is only lifted clear on one longitudinal side from the longitudinal slot or, respectively, from the housing defining it. This does offer the advantage that there is no need for complex channel-like passages, otherwise required, in the force coupling member for the covering band. The detent connection ensures a reliable dwell of the covering section of the covering band in the covering position, without material fatigue occurring producing any disadvantageous effects. For a reliable detent holding action use is made of actuating means kinematically coupled with the force coupling member and arranged to act on the respective covering band, more particularly on the outer face of the covering band.

Further advantageous developments of the invention are defined in the dependent claims.

Optimum fixation of the covering band in the covering position is ensured if the detent means are able to cooperate with mating detent means, which are provided on the housing of the linear drive. Nevertheless there is however also certainly the possibility of providing the mating detent means on an additionally provided sealing band for the inner slot opening, something which provides the additional advantage that the sealing band is reliably held in the sealing position.

Preferably, the detent means are constituted by a fork-like detent section of the covering section, which is preferably located on the edge part, opposite to the attachment section, and which more particularly cooperates with mechanical detent means, which are constituted by a holding lip extending in the longitudinal direction of the longitudinal slot and located on the second longitudinal side, opposite to the first longitudinal side, of the outer slot opening.

It would in principle be possible to so secure the attachment section to the housing of the linear drive that it participates in the pivotal motion of the covering section and accordingly the covering band functions as a pivoting part along its entire width. However a design is preferred in the case of which the attachment section is held immovably on the housing and in which the pivotal motion of the covering section and in which during the relative movement of the covering section a relative movement between the latter and the stationarily mounted attachment section takes place. One of the advantages of this arrangement is that any resilient elasticity of the covering band may provide a contribution to the return force acting on the covering section.

The covering band is preferably anchored at the attachment section in an attachment groove, open toward the longitudinal slot, in the housing. Assembly and fitting together takes place more particularly by insertion from the end via one of the two end openings of the attachment groove.

The design in accordance with the invention is admittedly more especially suitable for a covering means with only one covering band, which covers the entire width of the longitudinal slot in the covering position. However, it is possible to provide a covering means having two covering bands placed alongside one another, each covering band having a pivotally movable covering section, both covering bands contributing jointly to the complete covering of the longitudinal slot.

The actuating means provided for producing the detent connection are preferably located axially on either side of the force coupling member. Furthermore it is convenient to design the actuating means in the form of a component of a guide means kinematically coupled with the force coupling member, which controls the pivoting of the covering section on opening and closing the longitudinal slot.

The covering band consists conveniently of elastic plastic material and more especially of elastomeric material. Furthermore, any guide means present is preferably manufactured of plastic material.

In the following the invention will be explained with reference to the accompanying drawings.

DESCRIPTION OF THE PREFERRED EMBODIMENTS

Figure 1:
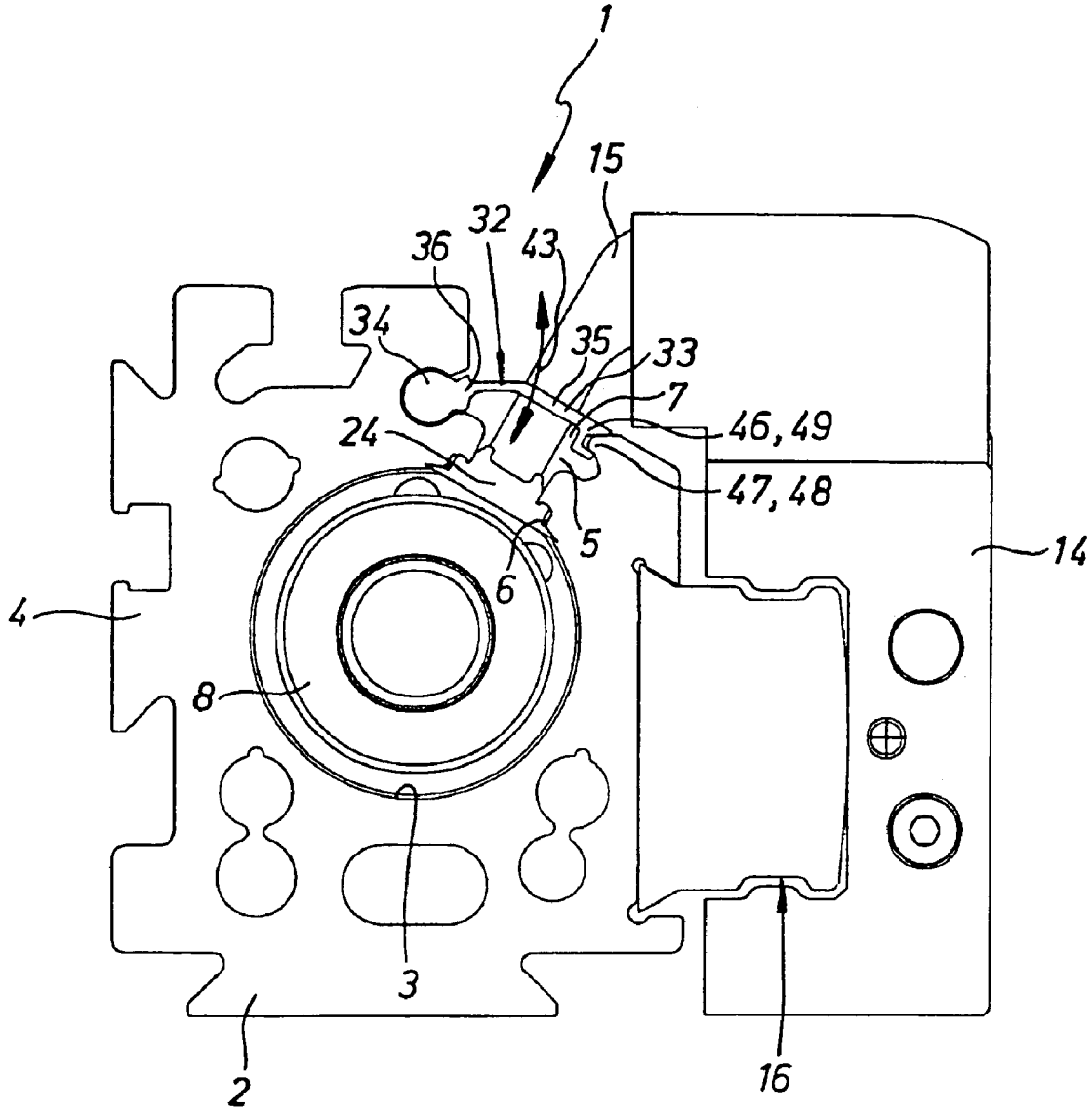
FIG. 1 is an end view of a first design of the piston rod-less linear drive with the housing cover removed so that the piston is visible.
Figure 2:
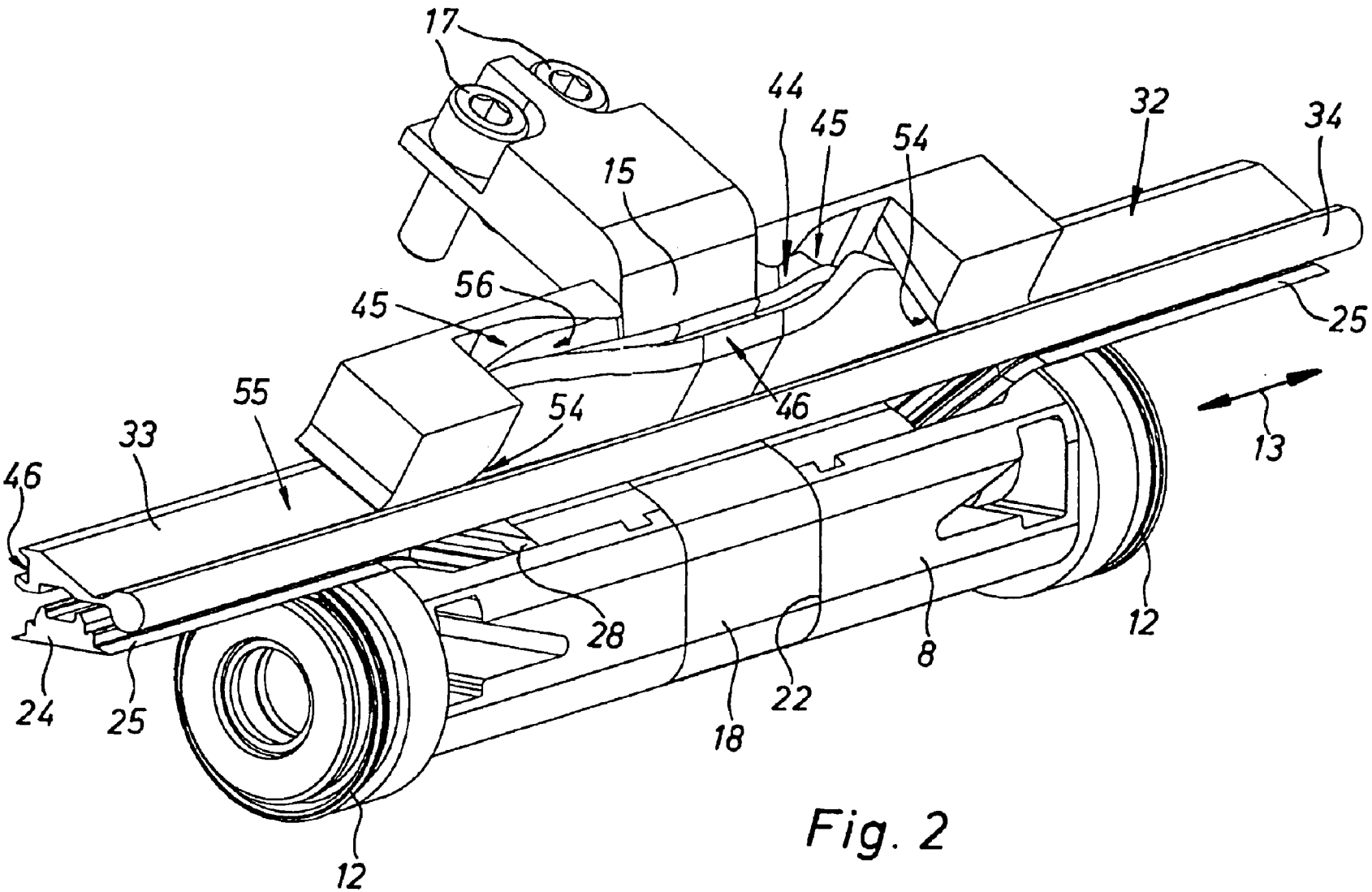
FIG. 2 shows part of the length of the linear drive in accordance with FIG. 1 in a perspective representation and omitting the housing.
Figure 3:
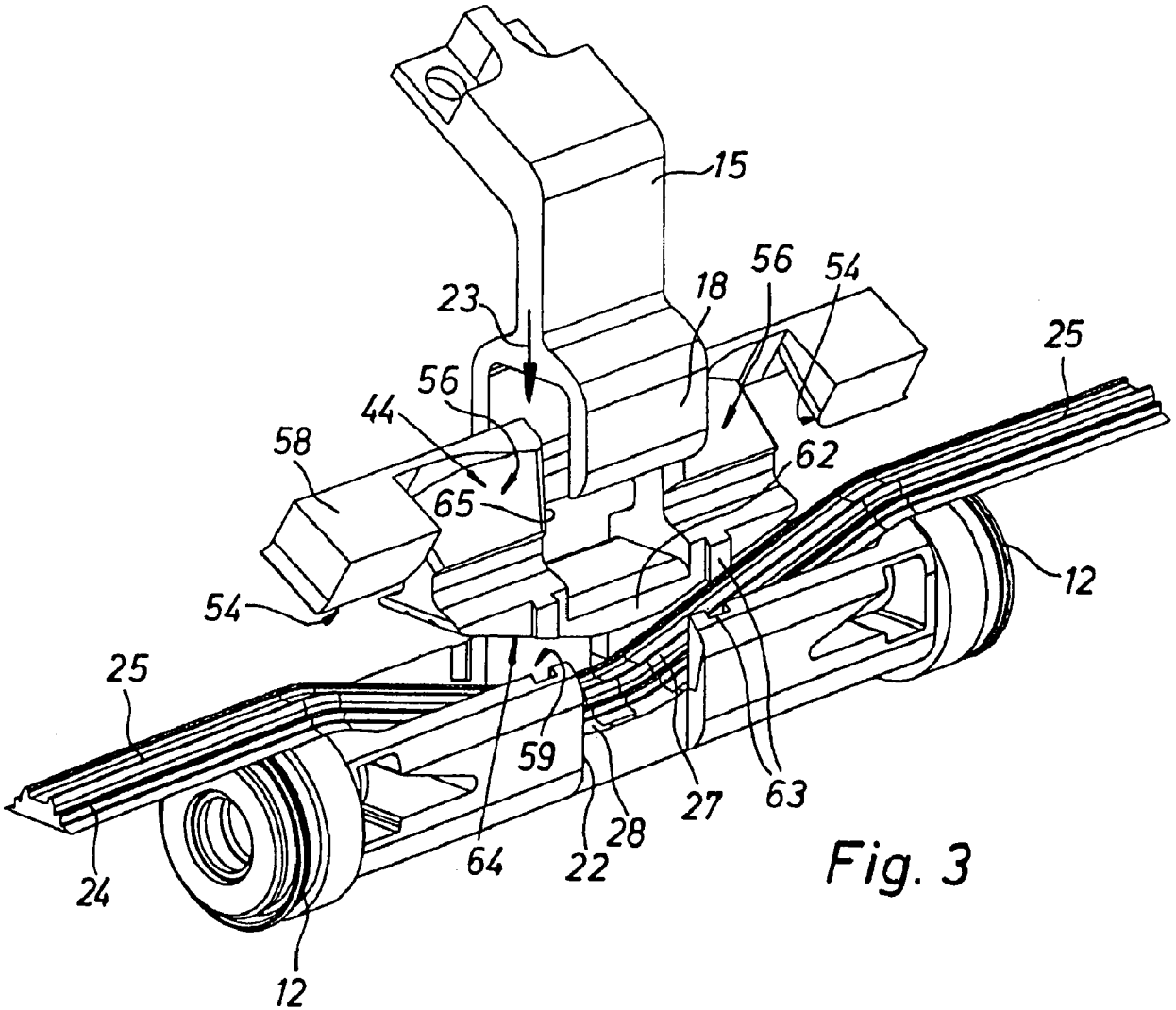
FIG. 3 is an exploded view of the components as viewed in FIG. 2 but omitting the covering band.

The piston rod-less linear drive of the working example generally referenced 1 is operated by fluid force and more particularly by compressed air.

The linear drive has a housing 2 with a longitudinal extent, wherein a piston receiving space 3 is formed extending in the longitudinal direction is provided having a preferably cylindrical cross sectional configuration. As a rule the housing 2 will comprise a tubular body, more particularly in the form of an extruded tubular section having terminal end covers, which in the drawing are not illustrated in detail.

The housing 2 possesses a longitudinal slot 5 extending approximately along length of the housing and which is more especially located in the tubular body 4. It extends through the wall of the housing 2 in the radial direction in the circumferential part of the piston receiving space 3 so that there is an inner slot opening 6 directed into the piston receiving space 3 and an outer slot opening 7 at the outer side of the housing 2. Both slot openings 6 and 7 extend in the longitudinal direction of the longitudinal slot 5.

Inside the piston receiving space 3 there is an axially moving piston. At axially spaced positions, preferably at the two axial end parts, it is provided with a respective sealing means 12, which cooperates with the inner face of the piston receiving space 3 in a sealing manner. Accordingly the piston receiving space 3 is divided up into three axially consecutive space parts, that is to say one middle space part between the two sealing means 12 and two outer space parts each adjoining the piston 8, which lie between a respective means 12 and the facing end cover of the housing 2 and which have the function of working spaces able to be subjected to fluid pressure.

By causing an operating fluid (which is supplied by way of fluid ducts, not illustrated, extending in the housing 2) to act in a controlled manner in the working spaces the piston 8 may be caused to move in the longitudinal direction of the housing. The direction of movement is indicated by a double arrow 13.

The linear movement of the piston 8 may be made available outside the housing 2 by a force transfer part 14, which is secured to a force coupling member 15, which in turn is kinematically coupled with the piston 8 in the direction 13 of motion. The force transfer part 14 possesses attachment means, not illustrated in detail, for the attachment of one or more objects to be moved. Preferably, the force transfer part 14 is guided externally on the housing 2 by a linear guide means 16 for running in the direction 13 of motion and is supported in the direction perpendicular thereto. Accordingly it is possible to prevent the piston 8 and the force coupling member 15 being subjected to excessive loads due to forces acting on the force transfer part 14. The force transfer part 14 may be designed in the form of a slide or carriage.

The force coupling member 15 may be termed an entraining member and extends-like a rib radially through the longitudinal slot 5. Attachment means 17, for example in the form of screws, serve for the attachment on the force transfer part 14. For the connection with the piston 8 the force coupling member 15 is provided at the end lying within the piston receiving space 3 with a forked holding section 18, which is plugged into the piston 8 from the longitudinal side thereof. The piston 8 has for this purpose a recess 22 receiving the holding section 18, and the dimensions of the recess 22 in the direction 13 of motion are equal to the dimensions of the holding section 18 so that there is an interlocking connection effective in the direction 13 of movement. Every axial movement of the piston 8 is accordingly transmitted free of play to the force coupling member 15. At the same time it is possible for there to be play in and opposite to the insertion direction 23, indicated by an arrow, of the holding section 18, such play being between the latter and the piston 8 so that there is an automatic compensation of any lack of parallelism of the piston receiving space 3 and the linear guiding means 16.

The inner slot opening 6 is provided with a flexurally elastic sealing band 24 which has the purpose of sealing off the two working spaces on either side of the piston 8 from the surroundings and preventing escape of the actuating fluid through the longitudinal slot 5. The sealing band 24 extends along the full length of the longitudinal slot 5 and has its outer sections 25, which are axially clear of the piston 8, in sealing engagement with the slot flanks 26, which delimit the longitudinal slot on either side thereof. The sealing contact is in this case generally in the transition zone between the piston receiving space 3 and the longitudinal slot 5, the sealing band 24, as illustrated, being able to extend fully or only partly into the longitudinal 5 from the inside.

At the same level as the piston 8 and accordingly in the middle space part between the two sealing means 12 the sealing band 24 is held for part of its length completely clear of the longitudinal slot 5, that is to say from the slot flanks 26. The lifted or moved clear section 27 of the sealing band here runs through a deflecting passage 28, defined in the interior of the piston 8, such passage extending underneath the force coupling member 15. It is in this manner that the force coupling member 15 can run through the longitudinal slot 5 without hindrance by the sealing band 24. Escape of fluid from the piston receiving space 3 is out of the question in this part, because the middle space part is separated by the sealing contact between the sealing means 12 and the sealing band 24 from the adjoining working spaces.

The outer opening 7 of the longitudinal slot 5 is provided with a covering means generally referenced 32. In the working embodiment illustrated in FIGS. 1 through 6 it comprises a single covering band 33, which like the sealing band 24 consists of plastic material and has rubber-elastic properties. Preferably, it is a question of a covering band 33 of elastomeric material.

The covering band 33 extends along the full length of the longitudinal slot 5 and its purpose is to prevent access of dirt into the slot 5 from the surroundings of the linear drive 1.

Independently of the actual position of the piston the covering band 33 seals of or obiturates the outer slot opening 7 on either side of the piston 8 axially, while at the same time rendering possible passage therethrough of the force coupling member 15. Unlike the case of the sealing band 24 the covering band 33 is however not completely cleared from the longitudinal slot 5, or the housing 2 defining it, in the vicinity of the force coupling member 15. The covering band 33 always remains firmly connected with the housing 2 at one longitudinal side of the longitudinal slot 5 and is only moved clear on the opposite longitudinal side and accordingly directed around the force coupling member 15. This means that there is the substantial advantage that the force coupling member 15 does not require any complex passage for the covering band 33, and in fact the band may run past on the outer face of the force coupling member 15.

As regards details the covering band 33 is divided in the longitudinal direction into two band sections adjoining each other at their longitudinal sides that is to say in an attachment section 34 and a covering section 35. The two sections 34 and 35 are integrally connected together, the connection zone defining a pivotal zone 36 with a pivot axis extending in the longitudinal direction of the covering band 33.

At the attachment section 34 the covering band 33 is fixed to a first longitudinal side 37 of the outer slot opening 7 and is therefore fixed in relation to the housing. For this purpose the attachment section 34 may be designed in the form of a bead and have a larger cross section than the adjoining covering section 35 so that the attachment section may be anchored in an attachment groove 42, open toward the longitudinal slot 5, in the housing 2. In the working embodiment the attachment section 43 is circular in shape and it is seated in a correspondingly formed section of the attachment groove 42, which merges into the narrower groove opening, through which the covering section 35 protrudes.

The transverse dimensions of the attachment section 34 and of the attachment groove 42 are more particularly so matched with each other that the attachment section 34 may be inserted from one end into the attachment groove 42 during assembly. With operation may take place using a light pressing force.

Figure 4:
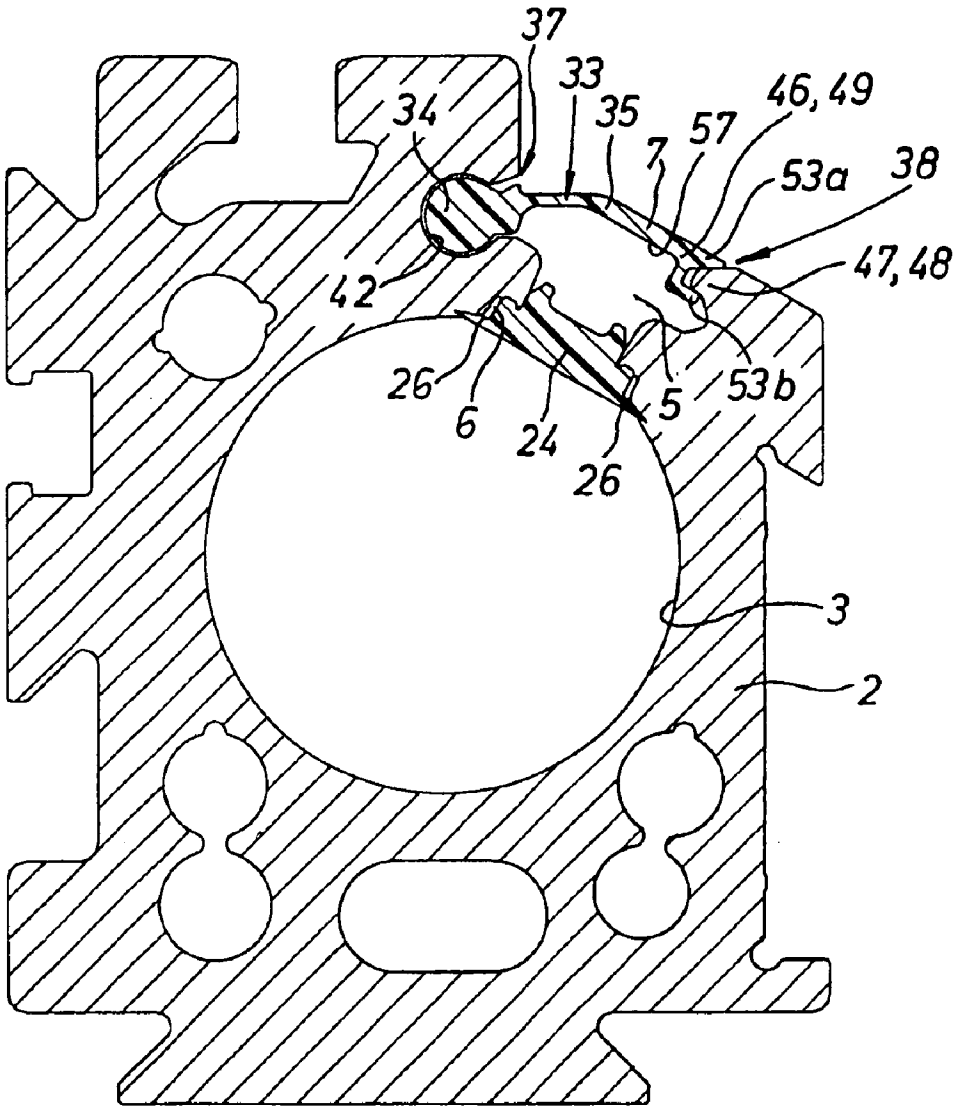
FIG. 4 shows the linear drive of FIGS. 1 through 3 in a cross sectional representation, the plane of section being axially outside the piston and only the housing, the covering band and the sealing band being illustrated.
Figure 5:
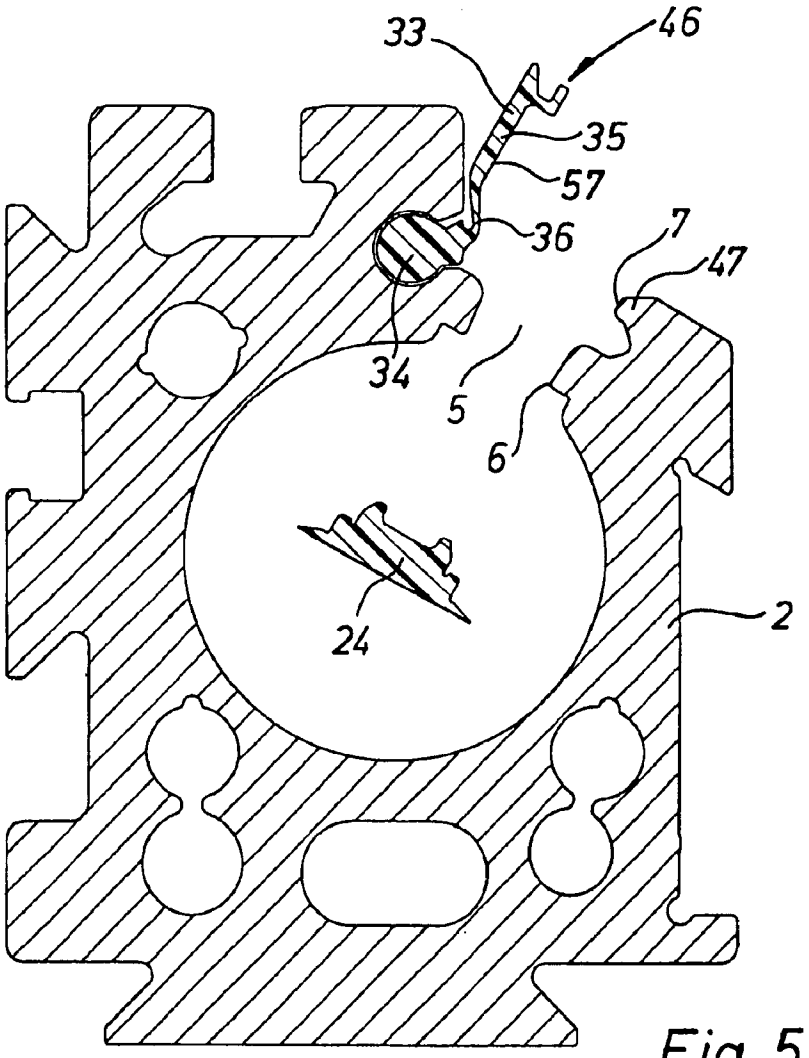
FIG. 5 shows a representation corresponding to FIG. 4 with the covering section pivoted into the opened or released position, the plane of section extending at the force coupling member, which is not illustrated.

The covering section 35 is able to be so pivoted between a covering position indicated in FIG. 4 and a released position indicated in FIG. 5 in relation to the attachment section 34 and accordingly in relation to the housing 2. The pivoting movement is indicated ba a double arrow at 43. In the covering position the covering section 35 extends between the longitudinal first side 37 and the second longitudinal side 38 opposite to it of the outer slot opening 7 and accordingly covers the outer slot 7 for its entire width. The covering section 35 may in this case partly or completely extend into the longitudinal slot 5 from the outside.

In the released position the covering section 35 is pivoted away from the housing 2 and accordingly uncovers the outer slot opening 7 for the passage or extension therethrough of the force coupling member 15.

The transition between the covering position and the released position is controlled by a guide means 44 kinematically coupled with the force coupling member 15 axially.

Its structure is such that it moves the covering section 35 at the same axial level as the force coupling member 15 and in axially adjoining transitional zones 45 into the released position and following this into the covering position. The released position is in this case characterized by a different size of pivot angle of the covering section 35, which at the level of the force coupling member 45 is at a maximum and in the course of the transitional zones 45 as far as the end of the guide means 44 and the following covering position gradually decreases.

A significant feature of the covering band 33 is that its pivotally moving covering section 35 possesses detent means 46, by the intermediary of which it is releasably held in the covering position. The detent holding action is responsible for a reliable touching contact between the longitudinal edge region 41, opposite to the attachment section 34, of the covering section 35 and the housing 2 at the associated second longitudinal side 38. With the detent action it is possible to achieve a bias effect between the above mentioned components, something which leads to a sealing contact to prevent the ingress of solid dirt or extraneous liquids in a reliable manner.

During the linear movement of the piston 8 the covering section 35 of the covering band 33 runs through the above mentioned guide means 22, the guide means 44 causing both the disengagement and also the detent enclosure of the covering section 35.

In the working examples in accordance with FIGS. 1 through 5 the detent means 46 of the covering section 35 cooperate with the mating detent means 47, which are provided directly on the housing 2 of the linear drive 1. Preferably, in this case the mating detent means 47 are constituted by a holding rib 48 extending in the longitudinal direction of the longitudinal slot 5, such rib 48 being located on the second longitudinal side 38 of the longitudinal slot 5 and extending toward the opposite slot edge. The detent means 46 comprise a forked detent section 49 of the covering section 35, in whose trough-like opening the holding rib 38 extends in the locked state. The holding rib 48 is in this case braced between the two fork prongs 53*a* and 53*b* of the detent section 49.

The inner fork prong 53*a* is deformable and is bent round during engagement and disengagement. One could speak of a snap-action connection in this case.

Accordingly there is the certainty of a play-free and therefore sealed detent connection, because the holding rib 48 is provided with a cross section tapering toward the free end and the intermediate space defined between the fork prongs 53*a* and 53*b* of the detent section 49 tapers in the depth direction also. This means that the detent engagement operation is more particularly aided.

The guide means 44 possesses actuating means 54 arranged axially on either side of the force coupling member 15, such actuating means 54 being able to cooperate with an outer face 55, facing away from the longitudinal slot 5, of the covering section 35 in order to lock the covering section 35 in relation to the housing on transition from the released position into the covering position. The actuating means 54 thrust against the outer face, 55 so that the covering section 35 is pivoted inward and is forced into a detent engagement with the mating detent means 47.

The actuating means 54 define the two outer ends of the transition zones 45 and are constituted by actuating faces, whose course is the same as the desired course of the covering section 35. They are curved, their distance from the outer slot opening 7 decreasing with an increase in the distance from the force coupling member 15. Accordingly the covering section 35 is thrust underneath the corresponding actuating face and during a corresponding direction of movement of the piston 8 is gradually thrust down onto the longitudinal slot 5.

Axially between the two actuating means 54 the guide means 44 is provided with an oppositely directed guide face 56. Starting at the end regions opposite to the actuating means, it becomes increasingly steep toward the force coupling member 15. Since the inner face 57 of the covering section 35 runs along the guide face 56, the course of the guide face 56 will determine the pivoting operation between the covering position and the release position. The guide face 56 is steepest in the middle of the action of the force coupling member 15, the latter being able to constitute a direct component of the guide face 56.

Apart from any component possibly present on the force coupling member 15, the guide face 56 is like the actuating means 54 and accordingly the entire guide means 44 provided on a single component, which single component in the working example constitutes an insert 58, which is inserted longitudinally into the piston 8. Preferably, the insert 58 consists of plastic material, the actuating 54 and the guide face 56 being more particularly manufactured by free molding. The production of the guide means 44 on a separate component of its own offers the advantage that complex shapes of the faces may be produced independently from the manufacture of the piston 8.

The fitting of the insert 58 in the piston 8 is preferably performed by plugging in place, the piston 8 possessing a recess 59 open toward one longitudinal side, into which recess 59 a foot section 62 of the insert 58 is plugged perpendicularly to the direction 13 of movement. Interlocking centering means, as for instance ribs and grooves, in this case ensure an exact fitting together.

The above mentioned deflecting passage is preferably arranged in the recess 59 and is partly defined by the piston 8 and partly by the foot section 62 of the insert 58. The latter can possess a deflecting face 64 facing the sealing band 24.

The force coupling member 15 could in principle be an integral component of the insert 58. For the reasons explained above however a separate design is however more advantageous. Thus in the working example the insert 58 is provided at the level of the recess 22 in the piston 8 with a further recess 65, which renders possible the insertion of the forked holding section 18, the insert 58 being ultimately held by the holding section 18 straddling it.

On movement through the guide means 44 the actuating means 54 act as holding down means, which thrust the covering section 35 into the engaged state. The guide face 56, placed in between, which may be made up of a plurality of sequentially following face sections, is responsible for moving the covering section 35 into the erect position in the released state for this purpose deflection around the force coupling member 15.

Figure 6:
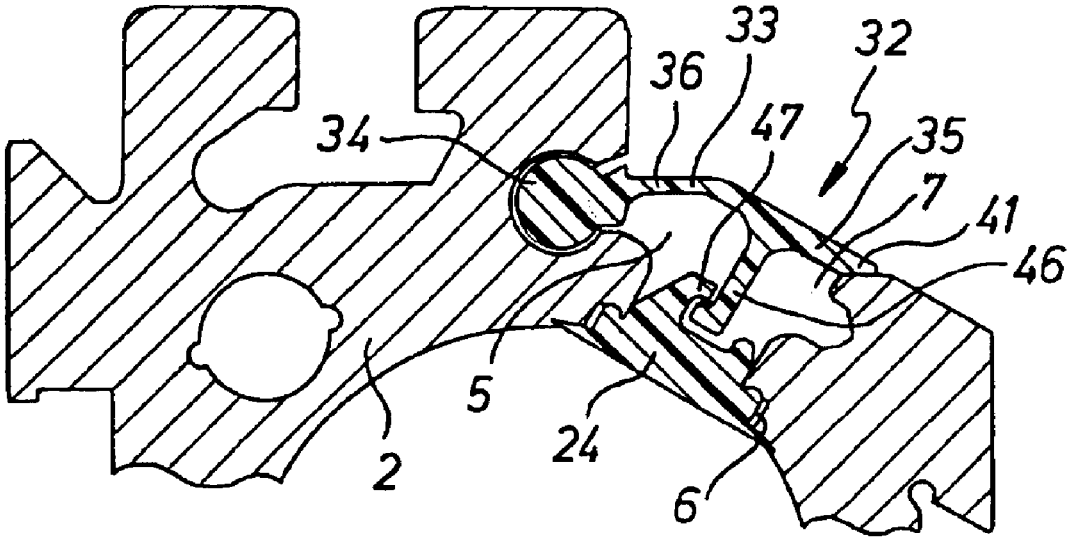
FIG. 6 shows in cross section part of a further design of the linear drive, the detent connection being provided between the covering band and the sealing band.

As shown in FIG. 6 a further design of the linear drive is possible, in the case of which the covering section 35 in the engaged state is again on the second longitudinal side 38 of the outer slot opening 7 is in clamping engagement with the housing 2. However, the mating detent means 47 in this case are not directly provided on the housing 2, but are on the face of the sealing band 24 facing the covering band 33, such sealing band engaging the housing 2. This design offers the advantage that the covering band 33 and the sealing band mutually hold each other in the covering position or sealing position.

Figure 7:
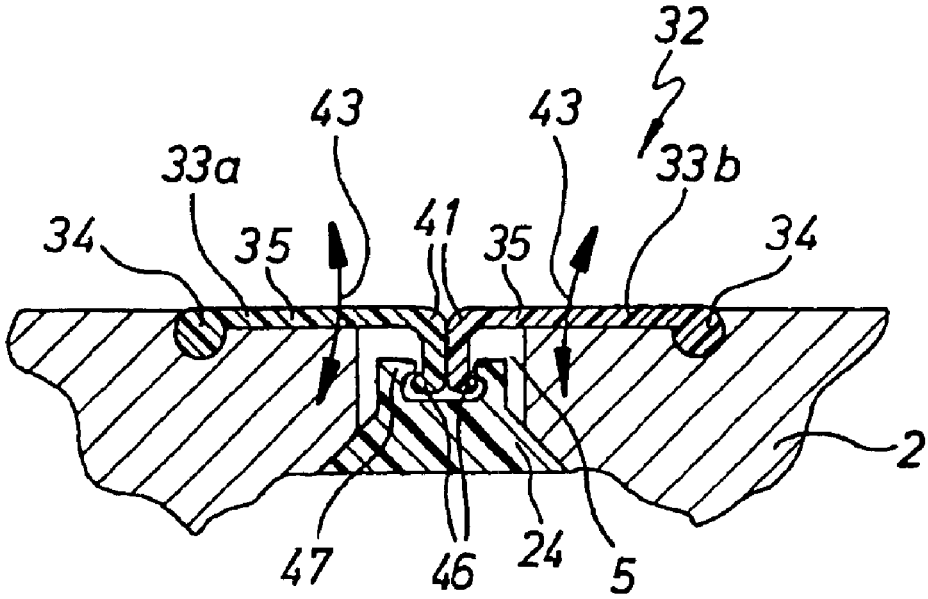
FIG. 7 shows a still further design of the linear drive in the case of which there is a covering means having two covering bands.

The design illustrated in FIG. 7 differs from the designs so far described to the extent that the covering means 32 has two covering bands 33*a* and 33*b* instead of only one. Each such covering band 33*a* and 33*b* possesses an attachment section 34 and a covering section 35, its attachment sections 34 being secured on opposite longitudinal sides of the longitudinal slot 5 in relation to the housing. Starting from this position their covering sections 35 project toward each other and respectively cover part of the width of the outer slot opening 7. In the working embodiment the arrangement is such that the longitudinal slot 5 is covered by both covering sections 35 in the covering position for half thereof.

The kinematic behavior of the two covering section is the same as that described above so that further explanations thereof are unnecessary. In the case of the design of the guide means 44 on the other hand the fact needs to be taken into consideration that the two covering sections 35 are pivoted in opposite directions. More particularly, each covering section 35 is provided with its own guide face so that the covering sections 35 are moved past the force transfer part 14 on opposite sides.

In the case of the design in accordance with FIG. 7 there is the particular opportunity of providing the detent connection in the covering position between the covering sections 35 and the sealing band 24. More especially, suitable detent means 46 may be formed on the mutually facing longitudinal edge regions 41 of the covering sections, such detent means cooperating with the shared mating detent means 47 of the sealing band 24.

What is claimed is:

1. A linear drive comprising a housing, which has a slot aligned longitudinally and having a movable force coupling member extending through it, the outer opening of the slot being provided with a covering means having at least one covering band, the covering band having an attachment section fixed to the housing on a first longitudinal side of the outer slot opening and a pivotal covering section able to be laterally pivoted about said attachment section between a covering position covering the outer slot opening and a free position permitting the extension of the force coupling member through the slot, wherein detent means are provided on the pivotally moving covering section for releasable detentwise locking in the covering position and that actuating means are provided kinematically coupled with the force coupling member, such actuating means acting on the associated covering band in order to bring about a detent locking effect.

2. The linear drive as set forth in claim 1, wherein, in the covering position of the covering section, the detent means are engaged with mating detent means provided on the housing.

3. The linear drive as set forth in claim 2, wherein the mating detent means are provided on the second longitudinal side opposite to the first longitudinal side, of the outer slot opening.

4. The linear drive as set forth in claim 1, wherein the detent means are provided on an edge region opposite to the attachment section of the covering section.

5. A linear drive comprising a housing, which has a slot aligned longitudinally and having a movable force coupling member extending through it, the outer opening of the slot being provided with a covering means having at least one covering band, the covering band having an attachment section fixed to the housing on a first longitudinal side of the outer slot opening and a pivotal covering section able to be pivoted between a covering position covering the outer slot opening and a free position permitting the extension of the force coupling member through the slot, wherein detent means are provided on the pivotally moving covering section for releasable detentwise locking in the covering position and that actuating means are provided kinematically coupled with the force coupling member, such actuating means acting on the associated covering band in order to bring about a detent locking effect, and wherein, in the covering position of the covering section, the detent means are engaged with mating detent means, which are provided on a sealing band provided for the inner slot opening of the longitudinal slot.

6. The linear drive as set forth in claim 1, wherein the detent means are constituted by a fork-like detent section of the covering section.

7. The linear drive as set forth in claim 6, further comprising a holding rib extending in the longitudinal direction of the longitudinal slot which rib fits in the covering position of the covering section as a mating detent means into the opening of the fork-like detent section.

8. The linear drive as set forth in claim 1, wherein the attachment section is fixed in a stationary manner on the housing and, between the covering position and the release position, the covering section performs a pivotal movement in relation to the attachment section.

9. A linear drive comprising a housing, which has a slot aligned longitudinally and having a movable force coupling member extending through it, the outer opening of the slot being provided with a covering means having at least one covering band, the covering band having an attachment section fixed to the housing on a first longitudinal side of the outer slot opening and a pivotal covering section able to be pivoted about said attachment section between a covering position covering the outer slot opening and a free position permitting the extension of the force coupling member through the slot, wherein detent means are provided on the pivotally moving covering section for releasable detentwise locking in the covering position and that actuating means are provided kinematically coupled with the force coupling member, such actuating means acting on the associated covering band in order to brine about a detent locking effect, and wherein the attachment section is anchored in an attachment groove in the housing, such groove being open toward the longitudinal slot.

10. The linear drive as set forth in claim 1, wherein the covering means comprises one single covering band, which in the covering position covers the longitudinal slot at the outer slot opening for its full width.

11. A linear drive comprising a housing, which has a slot aligned longitudinally and having a movable force coupling member extending through it, the outer opening of the slot being provided with a covering means having at least one covering band, the covering band having an attachment section fixed to the housing on a first longitudinal side of the outer slot opening and a pivotal covering section able to be pivoted about said attachment section between a covering position covering the outer slot opening and a free position permitting the extension of the force coupling member through the slot, wherein detent means are provided on the pivotally moving covering section for releasable detentwise locking in the covering position and that actuating means are provided kinematically coupled with the force coupling member, such actuating means acting on the associated covering band in order to bring about a detent locking effect, and wherein the covering means has two covering bands, which are fixed on opposite longitudinal sides of the longitudinal slot and cover the longitudinal slot in the covering position at the outer slot opening jointly for the full width since they respectively extend part of the width of the longitudinal slot.

12. A linear drive comprising a housing, which has a slot aligned longitudinally and having a movable force coupling member extending through it, the outer opening of the slot being provided with a covering means having at least one covering band, the covering band having an attachment section fixed to the housing on a first longitudinal side of the outer slot opening and a pivotal covering section able to be pivoted about said attachment section between a covering position covering the outer slot opening and a free position permitting the extension of the force coupling member through the slot, wherein detent means are provided on the pivotally moving covering section for releasable detentwise locking in the covering position and that actuating means are provided kinematically coupled with the force coupling member such actuating means acting on the associated covering band in order to bring about a detent locking effect, and wherein the measures for providing the detent action are such that in the covering position the covering section is braced against the housing on the second longitudinal side, opposite to the first longitudinal side, of the outer slot opening.

13. The linear drive as set forth in claim 1, wherein at least one covering band consists of elastic plastic material.

14. The linear drive as set forth in claim 1, wherein the actuating means are provided axially on either side of the force coupling member and dependent on the direction of movement of the force coupling member are responsible for the detent locking operation.

15. The linear drive as set forth in claim 1, wherein the actuating means belong to a guide means kinematically coupled with the force coupling member, which guide means control the pivoting of the covering section in such a manner that while temporarily assuming the released position the covering section is deflected around the moving force coupling member.

16. The linear drive as set forth in claim 1, the force coupling member is kinematically coupled with a piston sliding in the housing.

17. A linear drive comprising a housing, which has a slot aligned longitudinally and having a movable force coupling member extending through it, the outer opening of the slot being provided with a covering means having at least one covering band, the covering band having an attachment section fixed to the housing on a first longitudinal side of the outer slot opening and a pivotal covering section able to be pivoted about said attachment section between a covering position covering the outer slot opening and a free position permitting the extension of the force coupling member through the slot, wherein detent means are provided on the pivotally moving covering section for releasable detentwise locking in the covering position and that actuating means are provided kinematically coupled with the force coupling member, such actuating means acting on the associated covering band in order to bring about a detent locking effect, and wherein the force coupling member is kinematically coupled with a piston sliding in the housing, and wherein the actuating means are formed on an insert plugged into the piston on the longitudinal side.

18. The linear drive as set forth in claim 17, wherein the guide means is formed at least in part and preferably fully on the insert.

19. The linear drive as set forth in claim 17 wherein the force coupling member possesses a fork-like holding section, which is inserted from the side in the piston partly straddling the insert.

20. The linear drive as set forth in claim 1, wherein the linear drive is adapted to be cowered by a fluid.

* * * * *

UNITED STATES PATENT AND TRADEMARK OFFICE

CERTIFICATE OF CORRECTION

PATENT NO. : 6,910,408 B2
DATED : June 28, 2005
INVENTOR(S) : Weberruss et al.

It is certified that error appears in the above-identified patent and that said Letters Patent is hereby corrected as shown below:

Column 10,
Line 4, "in order to brine about" should read -- in order to bring about --.

Column 12,
Line 15, "to be cowered by a" should read -- to be powered by a --.

Signed and Sealed this

Seventeenth Day of January, 2006

JON W. DUDAS
*Director of the United States Patent and Trademark Office*